US008813873B2

(12) United States Patent
Beardmore et al.

(10) Patent No.: US 8,813,873 B2
(45) Date of Patent: Aug. 26, 2014

(54) ENHANCED SMEAR EFFECT FRACTURE PLUGGING PROCESS FOR DRILLING SYSTEMS

(75) Inventors: David H. Beardmore, Missouri City, TX (US); Paul D. Scott, Houston, TX (US); Rick D. Watts, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 102 days.

(21) Appl. No.: 12/790,076

(22) Filed: May 28, 2010

(65) Prior Publication Data

US 2010/0300760 A1 Dec. 2, 2010

Related U.S. Application Data

(60) Provisional application No. 61/182,499, filed on May 29, 2009.

(51) Int. Cl.
*E21B 17/22* (2006.01)
*E21B 33/13* (2006.01)

(52) U.S. Cl.
USPC ..... 175/72; 166/278; 166/292; 175/323

(58) Field of Classification Search
USPC ..... 166/278, 292; 175/72, 323
See application file for complete search history.

(56) References Cited

U.S. PATENT DOCUMENTS

| | | | | |
|---|---|---|---|---|
| 2,166,937 | A | 7/1939 | Bettis | |
| 2,495,073 | A | 1/1950 | Morris | |
| 2,776,111 | A | 1/1957 | Vance | |
| 7,493,948 | B2 * | 2/2009 | Cooper et al. | 166/241.3 |
| 7,530,408 | B2 * | 5/2009 | Cambus-Brunet et al. | 175/72 |
| 8,245,775 | B2 | 8/2012 | Cooper et al. | |
| 2004/0045741 | A1 | 3/2004 | Tessari et al. | |
| 2005/0167159 | A1 * | 8/2005 | Bailey et al. | 175/72 |
| 2006/0113113 | A1 | 6/2006 | Underwood et al. | |
| 2007/0089909 | A1 | 4/2007 | Freeman | |
| 2010/0181073 | A1 * | 7/2010 | Dupriest et al. | 166/308.1 |
| 2011/0253454 | A1 * | 10/2011 | Freeman | 175/72 |

FOREIGN PATENT DOCUMENTS

| | | |
|---|---|---|
| GB | 2396365 | 6/2004 |
| GB | 2418212 | 3/2006 |
| WO | 2009018536 | 2/2009 |
| WO | 2009080358 | 7/2009 |

* cited by examiner

*Primary Examiner* — Nicole Coy
(74) *Attorney, Agent, or Firm* — ConocoPhillips Company

(57) ABSTRACT

This invention relates to drilling a well, particularly an oil or gas well, where casing or liner will be installed to stabilize the wellbore. The present invention is intended to permit more drilling and longer lengths of casing or liner to be installed at one time. The present invention includes a combination of a smear tool and specially sized granular lost circulation material solids in the drilling mud which work together to close and seal leaking formations and fractures whether pre-existing or induced by drilling. By the natural collection of the inventive solids along with the conventional particles in the drilling mud to form a filter cake at the problem areas along the wall of the wellbore and the smear tool arranged to compress the filter cake into the problem areas, lost circulation is minimized. Maintaining circulation naturally allows for longer drilling cycles and potentially fewer liner joints in the well. As such, larger diameter boreholes are located in the hydrocarbon bearing formation and less time is spent installing casing or liner pipe.

18 Claims, 10 Drawing Sheets

ENHANCED SMEAR EFFECT FRACTURE PLUGGING PROCESS FOR DRILLING SYSTEMS

CROSS-REFERENCE TO RELATED APPLICATIONS

This application is a non-provisional application which claims benefit under 35 USC §119(e) to U.S. Provisional Application Ser. No. 61/182,499 filed May 29, 2009, entitled "ENHANCED SMEAR EFFECT FRACTURE PLUGGING PROCESS FOR DRILLING SYSTEMS" which is incorporated herein in its entirety.

STATEMENT REGARDING FEDERALLY SPONSORED RESEARCH OR DEVELOPMENT

None

FIELD OF THE INVENTION

This invention relates to drilling wells for producing fluids such as oil and gas and particularly to drilling wells where fracturing and lost circulation is a concern.

BACKGROUND OF THE INVENTION

In the process of drilling oil and gas wells, drilling mud is injected into the center of the drill string to flow down to the drillbit and back up to the surface in the annulus between the outside of the wellbore and drillstring to carry the drill cuttings away from the bottom of the wellbore and out of the hole. The drilling mud is also used to prevent blowouts or kicks when the borehole is kept substantially full of drilling mud by maintaining head pressure on the formations being penetrated by the drillbit. A blowout or kick occurs when high pressure fluids such as oil and gas in downhole formations are released into the wellbore and rise rapidly to the surface. At the surface these fluids can potentially release considerable energy that is hazardous to people and equipment. The drilling muds used for drilling oil and gas wells have been developed with weighting (densifying) agents to provide sufficient head pressure to prevent the initial release of high pressure fluids and gases from the formation. However, density alone does not solve the problem as the drilling mud may drain into one or more formations downhole lowering the volume of drilling mud in the hole and, thus, head pressure for the wellbore. The situation where drilling mud is draining into one or more formations is called "lost circulation."

Lost circulation and stuck pipe are two of the most costly problems faced while drilling oil and gas wells. To reduce the likelihood of lost circulation, particles of "lost circulation material" (commonly called "LCM") are added to drilling muds to plug the formations into which the drilling mud is being lost. It is a simple and elegant solution in that the particles flow toward the leaking formation carried by the drilling mud and then collect in the leaking formation at the side of the wellbore. Eventually, however, when losses of drilling fluid become excessive, it is necessary to stop drilling and install a string of casing to seal off the portion of the existing wellbore so that drilling may re-commence at the bottom of the casing string. Installing casing or liner creates substantial costs as drilling is suspended while the casing is installed and cemented. Expenses for the installing casing string are only part of the cost as the day rates for the drilling rig and personnel continue while further progress on drilling stops.

It should also be noted that the interior dimension of the hole is reduced as each successive string of casing is added to the borehole. It is common to require a minimum diameter within the casing at the target zone in order to produce hydrocarbons that may be present when considering the space needed for tubing, valves, pumps and other equipment. Thus, the borehole is initially drilled substantially oversized anticipating successively smaller wellbore dimensions with each string of casing. It is also incumbent on the drilling crew to reach milestones before a new string of casing is installed so as to preserve final interior dimension of the casing.

The second area of substantial added cost for well drilling is when pipe gets stuck in the hole. This includes stuck drillstrings and stuck casing and stuck wireline logging tools. These pipes are often stuck because permeable zones allow the differential pressure of the drilling fluid hydrostatic pressure and formation pressure to stick the drill string against the filter cake with greater force than can be applied to pull the pipe loose. In addition, wellbore collapse and debris from the spalling or breakout of rock often cause stuck pipe.

Casing drilling is an operation where the drill string is actual casing pipe instead of the normal smaller diameter drill pipe. This casing drilling process has been partially effective at reducing lost circulation and improving wellbore stability through what has been called the smear effect. The smear effect is the mechanical conditioning of the wellbore and any filter cake, reducing permeability and packing any fractures or loss zones with drilling mud and cuttings. However, casing drilling is not applicable to all wells and has not been effective at reducing these problems in all areas and for all well configurations.

SUMMARY OF THE INVENTION

The present invention relates to a process for drilling a wellbore with a drillbit at the end of a drillstring with minimal loss of drilling fluid and minimal casing operations. A drilling fluid is provided with granular lost circulation material wherein the lost circulation material comprises particles for accomplishing enhanced smear fracture plugging where the lost circulation material particles have a particle size distribution from about 100 microns to about 1500 microns with substantial populations of particles throughout the entire range of the particle size distribution. The particles of the lost circulation material are also in the drilling fluid in a range from at least 0.5 pound per barrel up to 15 pounds per barrel to flow with the drilling fluid and also to form plugs at any lost circulation areas at the periphery of the wellbore and form a filter cake at such lost circulation areas and block or reduce fluid flow from the wellbore into the lost circulation areas. A drillstring is provided with at least one smear section along a portion of the perimeter of the drillstring to smear filter cakes of lost circulation material into lost circulation areas and compress the lost circulation material into more secure plugs to enhance the performance of the lost circulation material at the lost circulation areas, where the smear section has a smear surface that has an effective diameter of at least about 75% of the diameter of the wellbore and smears the walls of the wellbore as the drill string rotates. The drillstring is rotated to drill the wellbore further into the earth and turn the smear section so that the smear surface smears along the inside surface of the wellbore and especially press the lost circulation materials into a plug of more dense mass of particles and condition the lost circulation areas to reduce lost circulation, pipe sticking, and spalling.

In a particular aspect of the present invention, the smear section comprises casing pipe in a casing drilling arrangement or liner pipe in a liner drilling arrangement.

In a second alternative aspect of the present invention, the smear section comprises a tool installed onto a section of drill pipe or between two sections of drill pipe in a conventional drilling arrangement. An assortment of smear tools are shown and disclosed.

While the first preferred range of particle size distribution for the lost circulation material is in the range from 100 microns to 1500 microns it is more preferred to have the range extend to various wider ranges where the lower end of the range is 75 microns and even as low as 50 microns. The upper end of the range may more preferably about 2000 microns, about 2500 microns, about 3000 microns, about 3500 microns and including as high as about 4000 microns. It should be noted that across the range, substantial populations of particles should present in the drilling fluid to be available for plugging lost circulation zones or areas.

In a particularly preferred arrangement the lost circulation material comprises a combination of about one third fine ground nut hulls with a d50 of about 600 microns; about one third medium ground nut hulls with a d50 of 1500 microns; and one third coarse ground calcium carbonate 250 with a d50 of 250 microns. The d50 number is the diameter of the particle that is within the range where fifty percent of the particles are smaller and fifty percent of the particles are larger.

BRIEF DESCRIPTION OF THE DRAWINGS

The embodiment of the invention which uses a special smear tool instead of casing drilling techniques, together with further advantages thereof, may best be understood by reference to the following description taken in conjunction with the accompanying drawings in which.

DETAILED DESCRIPTION OF THE INVENTION

Figure 1:
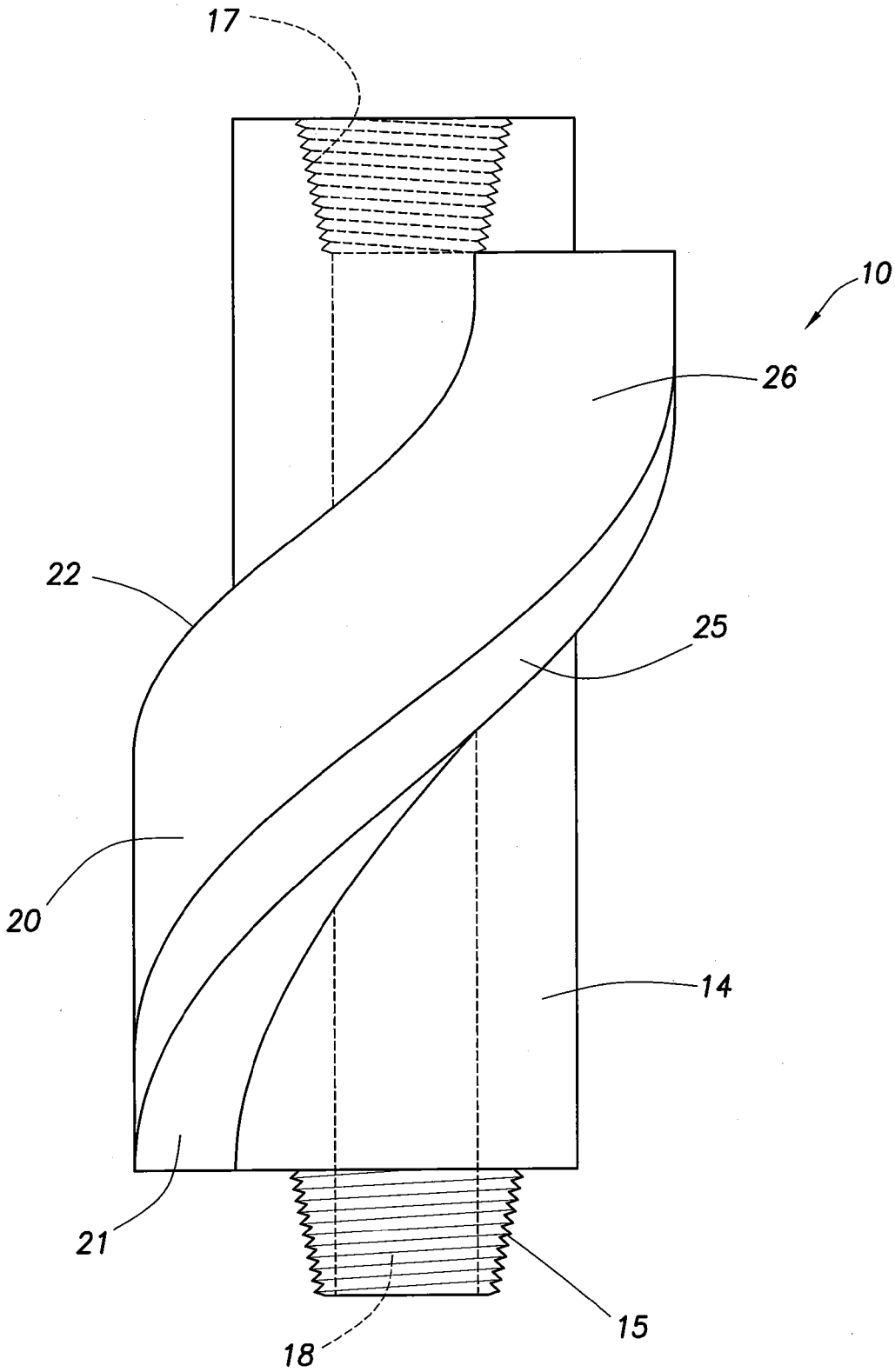
FIG. 1 is a front elevation view of a first embodiment of a smear tool of the present invention.

Turning now to the preferred arrangement for the present invention, reference is made to the drawings to enable a more clear understanding of the invention. However, it is to be understood that the inventive features and concept may be manifested in other arrangements and that the scope of the invention is not limited to the embodiments described or illustrated. The scope of the invention is intended only to be limited by the scope of the claims that follow.

As a wellbore is drilled from the surface down into the earth through many layers of rock, sand, shale, clay and other formations, many of these formations are relatively impermeable. In other words, these impermeable formations generally do not accommodate liquids or permit gas or liquids to pass through. However, there are formations that are permeable and some of these permeable formations have fluids that are under pressure. The fluids primarily include both salt and fresh water but may include oil, natural gas and mixtures of these and other fluids. Fluids that are under pressure in formations in the ground present a concern to the drilling operators in that a lot of force may be released through the penetration of such formations by the drilling equipment. In the event of an uncontrolled release of such high pressure fluids into the borehole may cause a destructive blowout.

As described above, to maintain control of these high pressure fluids, drilling fluids have been developed that have high density to maintain high wellbore pressure that is higher than any expected formation pressure. High density is conventionally achieved by the addition of weighting agents or densifying agents that comprise small, but very dense particles. Particle sizes of such weighting agents is typically less than 100 microns. Even without weighting agents, drilling fluids typically accumulate very small particles called drilling solids that are also about 100 microns or less. The drilling fluid accumulates particles of this size as they are believed to created as cuttings break-up or fracture and because of their small size, are not removed by mesh size of the shakers. Thus, drill cuttings larger than 100 microns are typically removed at the surface to avoid having the drilling fluid becoming overwhelmed with cuttings before being recirculated into the well.

Drilling fluids have a number of functions such as lubricating moving parts, cooling the bit and carrying drill cuttings to the surface. The maintenance of wellbore pressure is simply another important function of drilling mud or drilling fluid. However, the drilling fluid level must be closely monitored as the drillbit will encounter and create fractures, fissures and highly porous regions that will receive or adsorb the drilling fluid. Drilling fluid is continuously added to the wellbore, but in the event that fluid loss is substantially faster than the rate that the drilling fluid is added, the fluid head pressure in the wellbore reduces and the vulnerability of experiencing a kick or blowout increases. Again, drilling fluid technology has advanced to aid in managing this situation as well. In particular, modern drilling fluids include particles that collect at the fractures, fissures, vugs and porous regions to close off these openings to further fluid loss. These particles collect at these porous formations forming a plug, or filter cake where the liquid fluid has already passed out of the wellbore and into the formation.

To enhance the effectiveness of the particles in sealing these openings like porous formations and induced fractures, a combination of a drill string having certain physical characteristics along with a preferred selection of lost circulation material present in the drilling fluid has shown surprising results in maintaining the stability of the walls of the wellbore for longer periods so that the drilling of longer well sections between installation of casing strings is practical. The reduction of a single casing string is a significant financial advantage for an oil or gas well as most of the cost for casing a borehole is in the number of strings installed, not so much the depth of each casing string. In other words, there is not much additional cost in adding more length to a single casing string and a well of a certain depth is far less expensive with three casing strings versus four casing strings.

The present invention provides a means of mechanically conditioning permeable formations to reduce their permeability thereby reducing the likelihood and amount of lost circulation, reducing the likelihood of differential sticking of the drillstring to the side of the wellbore, and mechanically conditioning unstable formations to reduce the likelihood of breakout of rock (spalling) and wellbore collapse which also causes stuck pipe.

Thus, the advantage of the present invention in permitting longer and deeper drilling cycles by maintaining the integrity of the open walls of the wellbore cannot be overstated.

Focusing on the physical characteristics of the drillstring of the present invention, in one embodiment, it includes a smear section which can be either a bottom hole assembly with one or more smear tools to mechanically press the particles or filter cake into the openings and fissures. In another embodiment, it has a diameter of at least 75 percent of the diameter of the wellbore for at least 10% of the length over at least the bottom 300 feet of the drillstring. A smear section would include casing and liner drilling, sometimes called "casing while drilling." The smear tool or the large diameter segments cause smearing and compression and compaction of the cake into the openings and fissures in the walls of the wellbore. It is believed that this action of smearing and compression and compaction of the particles maintains the stability of the wellbore and specifically the walls for more effective maintenance of the circulation of the drilling mud. One preferred example of such a drill string is casing or liner drilling where the drillstring is large diameter and the annular space for carrying the cuttings to the surface is "tight" in comparison to the diameter of a conventional drill string. Casing drilling is not simply the substitution of casing for drillpipe as the drillbits are different and issues with directional drilling are significant for a casing string that is much less tolerant of bending.

However, this invention is not simply related to having a large diameter drillstring. After all, casing drilling has been known and used for quite some time and the benefits of the present invention have not been seen without the use of the preferred lost circulation material. The preferred lost circulation material is preferably a combination of one or more certain granular materials having a preferred particle size distribution. What is believed to make an effective lost circulation material (sometimes called "LCM") is to have a relatively broad particle size distribution where substantial populations of particles exist throughout the entire particle size distribution. Where existing LCM's seem to fall short is that there is insufficient populations of particles at portions of the needed particle size distribution. The present invention was at least partially inspired when lost circulation problems were resolved by adding extra amounts of smaller particle size materials. Apparently, there are lost circulation zones that are not adequately plugged without particles in a broad range of sizes that are also subjected to the smearing of a smear surface. With the present invention, lower amounts of LCM may be added or maintained in the drilling fluid. It is conventional to provide LCM at ten pounds per barrel in the drilling fluid. With the present invention, LCM may be present about less than about eight pounds per barrel and may more preferably be present at less than five pounds per barrel.

The most preferred materials are selected from ground nut hulls and calcium carbonate (ground marble) and combinations thereof although other suitable known LCM material or proppant materials may be used. The suitable choices include granular materials such as ground nut shells, calcium carbonate, graphite, coke, carbon, sulfur, plastic, resins, sand, crushed rock of all types, metal particles, ceramics, glass beads, expanded perlite, hard rubber compounds, urethane, crushed cement, crushed coal, and mixtures of one or more such materials, but are not limited to these materials. The preferred LCM may be formulated into a single blended product or it can be formulated at the wellsite using a combination of products where the full spectrum of particle size distribution is provided into the drilling fluid. The particle size distribution is a particularly important aspect of the LCM such that minimal amounts (less than about 6%) are smaller than about 128 micron or 120 mesh and trace amounts are larger than 2001 microns or 5 mesh. The formulation includes at least two percent at about 120 mesh or 128 micron with an increasing population from 120 mesh to 10 mesh so that the highest population being between 36 and 10 mesh based on weight percent. This formulation having the median particle size in the range between 500 and 2000 microns A second example of an effective combination of granular LCM's is: ⅓ (by weight) of fine ground nut hulls) called "Nut Hulls Fine" in the trade (which are ground nut hulls with a d50 of about 600 microns); ⅓ (by weight) of medium ground nut hulls (called "Nut Hulls Medium" in the trade (which are ground nut hulls with a d50 of about 1500 microns); and ⅓ by weight Calcium Carbonate 250 (which is ground marble with a d50 of 250 microns) or ground nut shells in the same size range.

These particle size distributions ("PSD"s) are known to be effective for certain pipe to hole diameter ratios, bit types and formations so that lower concentrations (typically measured in pounds per barrel) may be confidently used, but this invention is not limited to these exact PSD's. The key feature of this invention is that the particle size distribution is selected to be between or overlap the particle size of the drilling fluid being used (usually 0 to 100/150 microns) and the drill cuttings (usually with a d10>250 microns) being generated. For larger drill cutting sizes the PSD would have much larger particles and the concentration within any given range may be more or less than the preferred example above.

Another way of describing the preferred range of particle size distribution is that the range is from about 100 microns to about 1500 microns where substantial populations of particles throughout the range are present in the drilling fluid. It is more preferred to have the lower end of the range be about 75 or even as low as about 50 microns. The upper end of the range may be about 2000 microns, about 2500 microns, about 3000 microns, about 3500 microns and including about 4000 microns.

The concentration of the mixed, granular LCM should be about 0.5 to 15 ppb (pounds per barrel of drilling fluid). In practice, the LCM is added to the drilling fluid continuously at this concentration while drilling. The LCM particles are large enough that when the drilling fluid returns to the surface and goes over the shale shakers on the drilling rig, the LCM is removed by the shaker screens. As a result, the LCM would need to be replenished, but there may be times where the shakers might be bypassed for a short duration of drilling so that the LCM would be recycled. Also, shaker systems are available that can recycle a specific desired size range or PSD for LCM into the drilling fluid.

As described above, in some arrangements, the smear tool is actually the casing or liner pipe when drilling by a method known as casing or liner drilling. It is not always practical to drill with casing or liner pipe for various known reasons such as where the additional costs of casing drilling are not justified, or when the well is a deviated well and casing resists bending or the casing connections are too weak.

To obtain the benefits of smearing where casing or liner drilling is not suitable, several smear tools have been developed which are designed to press the special LCM, filter cake and cuttings into the fractures, voids, fissures and vugs to plug leaks, increase wellbore strength due to increased hoop stress, maintain well control and/or limit losses of the drilling fluid. The smear tools are designed to press the inside surfaces of the wellbore and not scrape or scratch the inside surface to avoid opening up any fractures, void, fissures vugs and the like.

Figure 2:
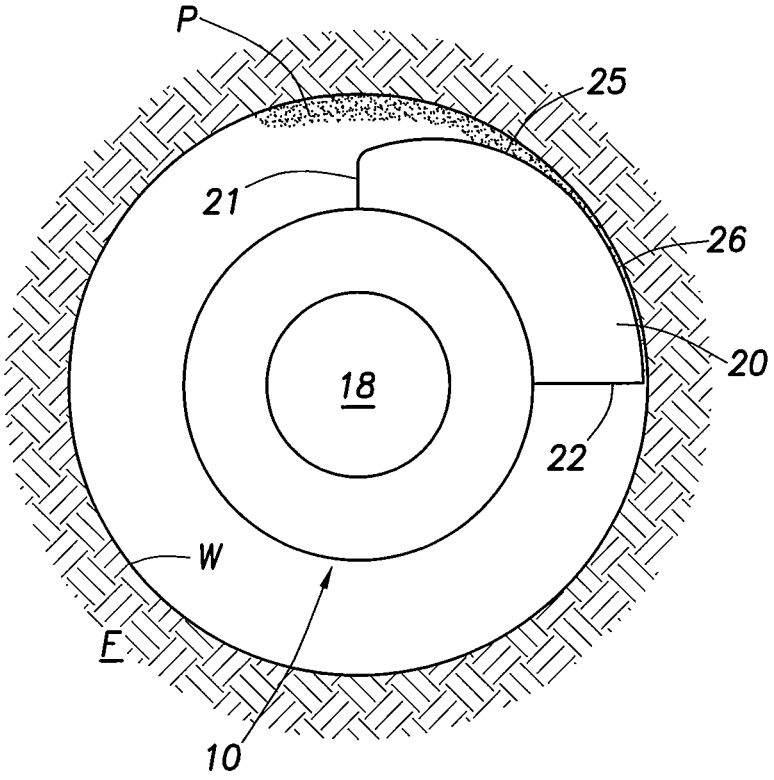
FIG. 2 is a top cross sectional view of the first embodiment of the smear tool inside a borehole.

Referring now to FIGS. 1 and 2, a first embodiment of a smear tool is indicated by the arrow 10. The smear tool comprises a main body 14 that may be characterized as a pipe joint or drillpipe joint that is approximately the same diameter as conventional drillpipe. While a typical length of drillpipe is 30 feet, the smear tool is shown being shorter. The length of a smear tool could be from about 5 feet long to 60 feet long. The smear tool includes external pipe threads 15 at the base and internal pipe threads 17 at the top with an axial passage 18 indicated by dashed lines. All smear tools presented herein may have any number of different threaded connection orientations, including "pin-up", "double pin", and "double box" or others. With the threads 15 and 17, the smear tool may be added to a drillstring between two joints of drillpipe and the axial passage is aligned with and approximately the same dimension as the passage through the drillpipe. Attached to the periphery of the body of the smear tool is the trowel 20. Trowel 20 is comprised of a helical blade that wraps around the body of the smear tool 10 with a small front nose 21 and a broader trailing end 22. The working surfaces of the trowel 20 are the leading surface 25 and the main smear surface 26. The leading surface 25 is shaped to capture the particles P along the inside wall W of the wellbore and push the particles firmly against the wall W as the smear tool 10 rotates with the drillstring. Main smear surface 26 follows the leading surface to maintain and continue a broad pressure on the particles that form the cake. As the particles are forced into tighter proximity, the interstitial spacing between the particles is reduced and the rate at which fluids may pass through the compressed filter cake should be reduced. While the trowel 20 is not shown to have fully wrapped around the body of the smear tool 10, an extended smear tool with one or more full wraps may easily be seen to meet the general features shown in FIG. 1.

Figure 3:
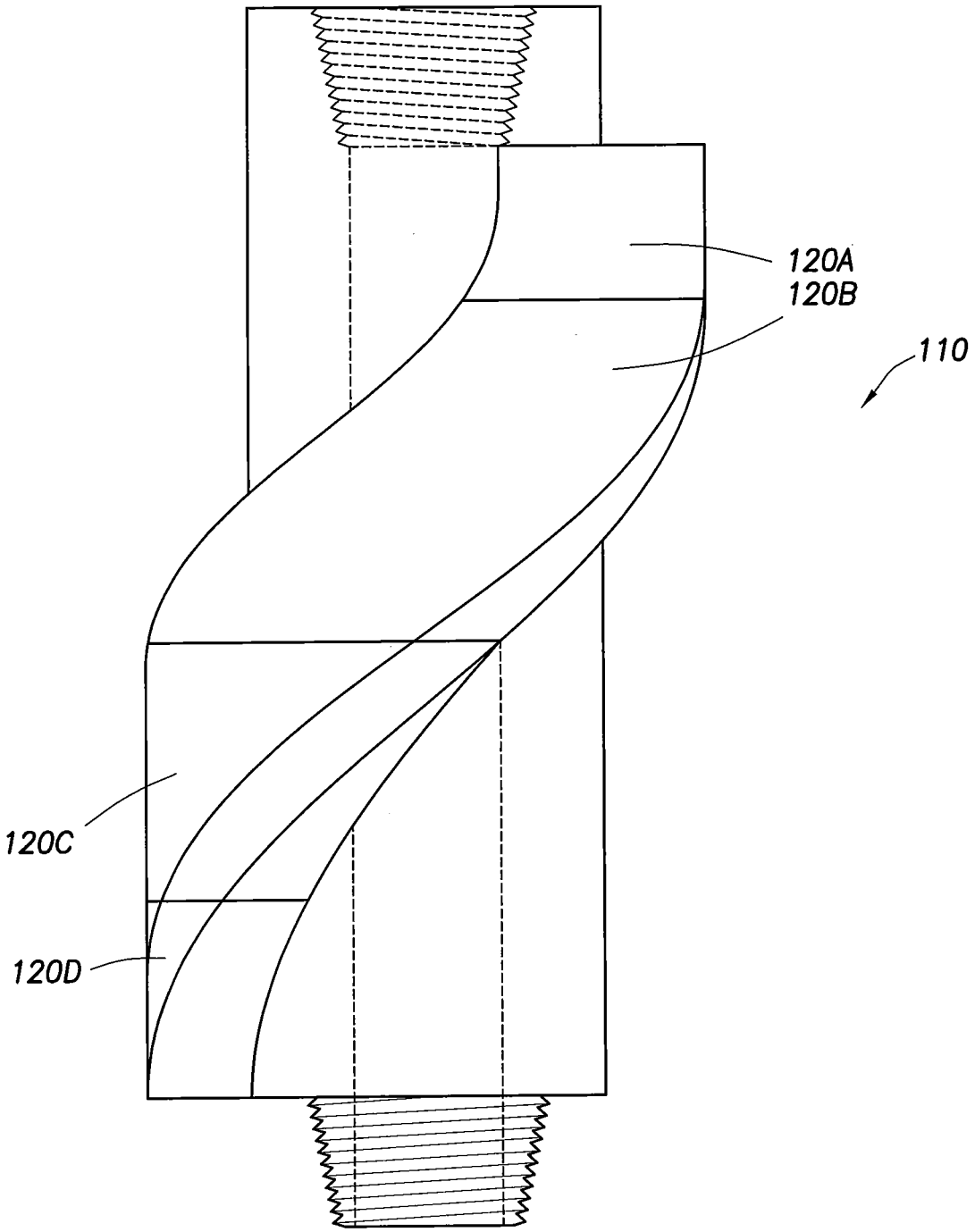
FIG. 3 is a front elevation view of a second embodiment of a smear tool of the present invention.
Figure 4:
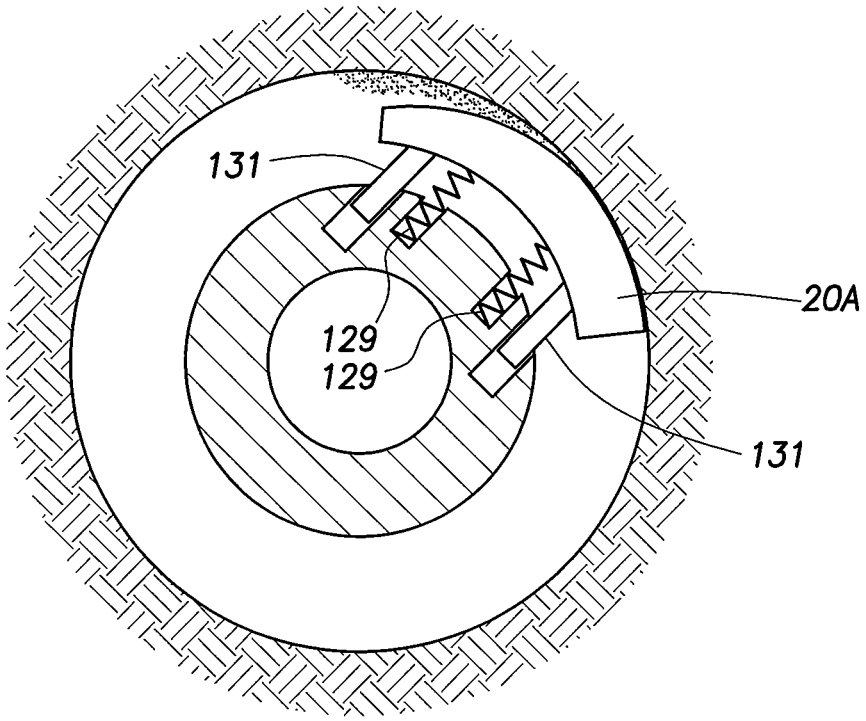
FIG. 4 is a top cross sectional view of the second embodiment of the smear tool inside a borehole.

A second embodiment of the invention is shown in FIGS. 3 and 4 where a smear tool is indicated by arrow 110. The smear tool 110 is very similar to smear tool 10 except that the trowel is formed of a number of segments. Four segments are illustrated and indicated by numbers 120A, 120B, 120C and 120D. Each segment is spring mounted to accommodate deflection of each of the trowel segments by springs 129 while pins 131 help maintain alignment of the trowel segments with the body of the smear tool 110. The purpose of allowing deflection is so that the smear tool will have less negative effect on the directional drilling aspect of a well operation.

Figure 5:
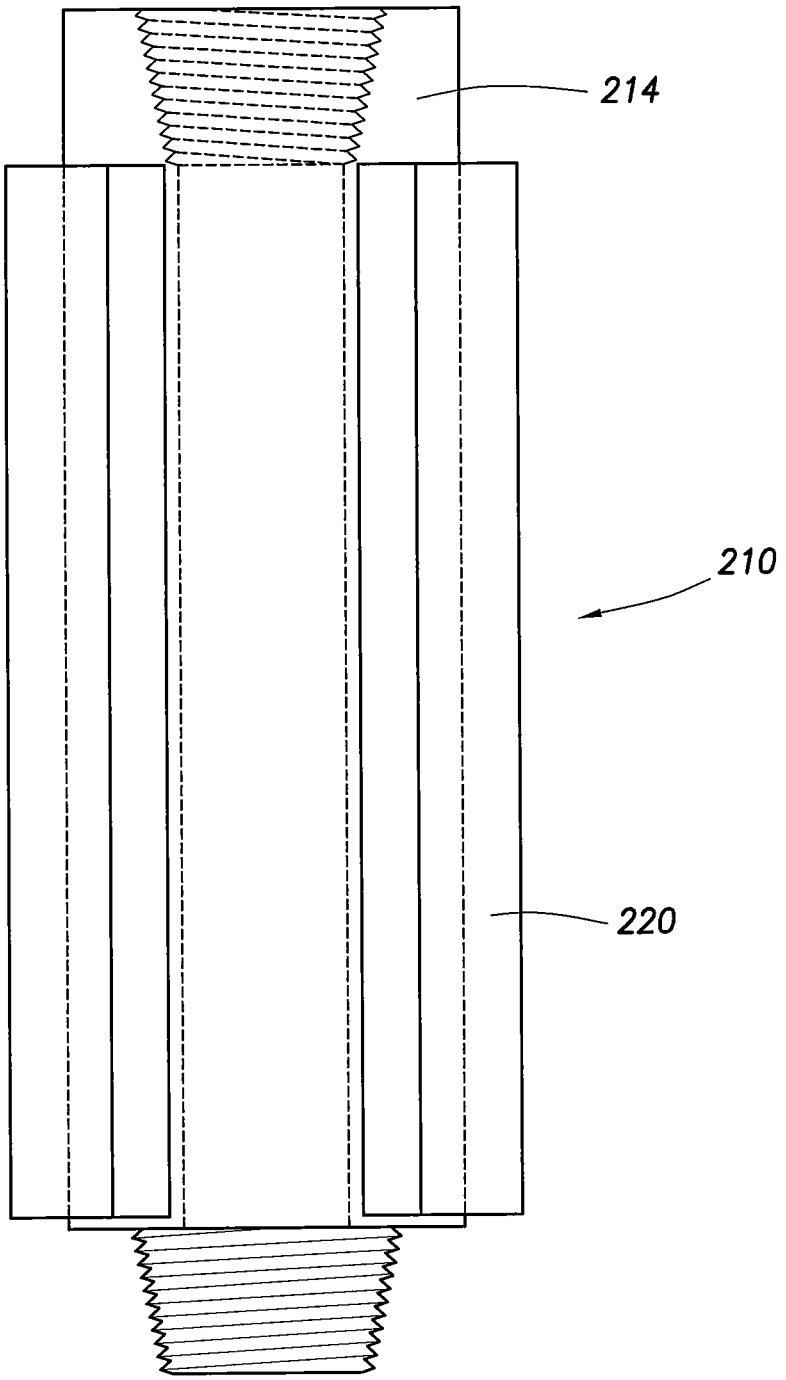
FIG. 5 is a front elevation view of a third embodiment of a smear tool of the present invention.
Figure 6:
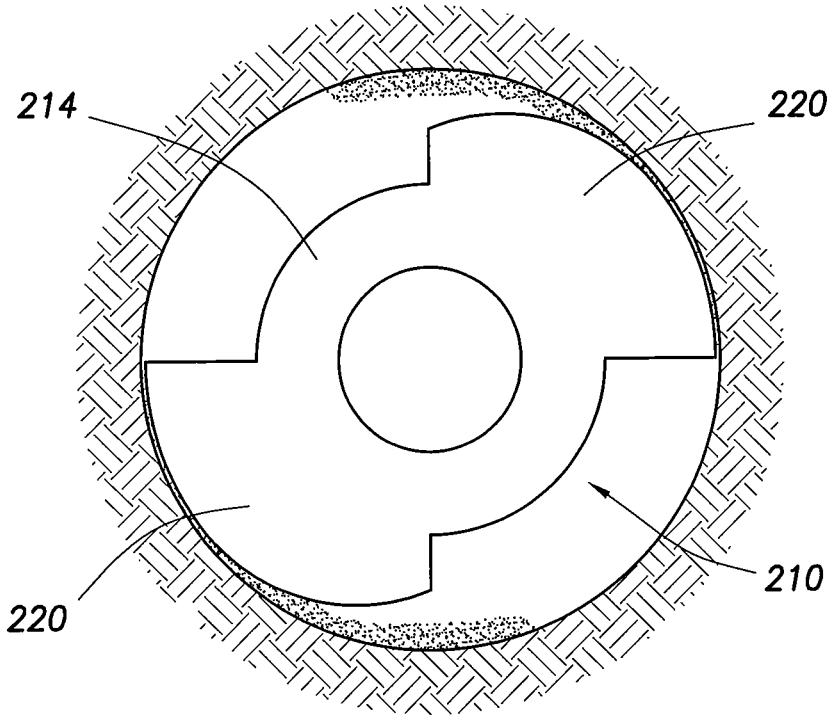
FIG. 6 is a top cross sectional view of the third embodiment of the smear tool inside a borehole.

Another embodiment of the invention is shown in FIGS. 5 and 6 where smear tool 210 is shown to have two trowels extended approximately the length of the body 214 of the tool. The trowels 220 include a contour similar to the prior embodiments to press the particles of cuttings and the filter cake into the wall of the wellbore. With two trowels 220, it is expected that more pressure will be imposed on the filter cake. It should also be understood that three, four and more trowels could be mounted on the underlying body of the smear tool. It should also be seen that the trowels 220 are straight rather than helical which should be easier to construct.

Figure 7:
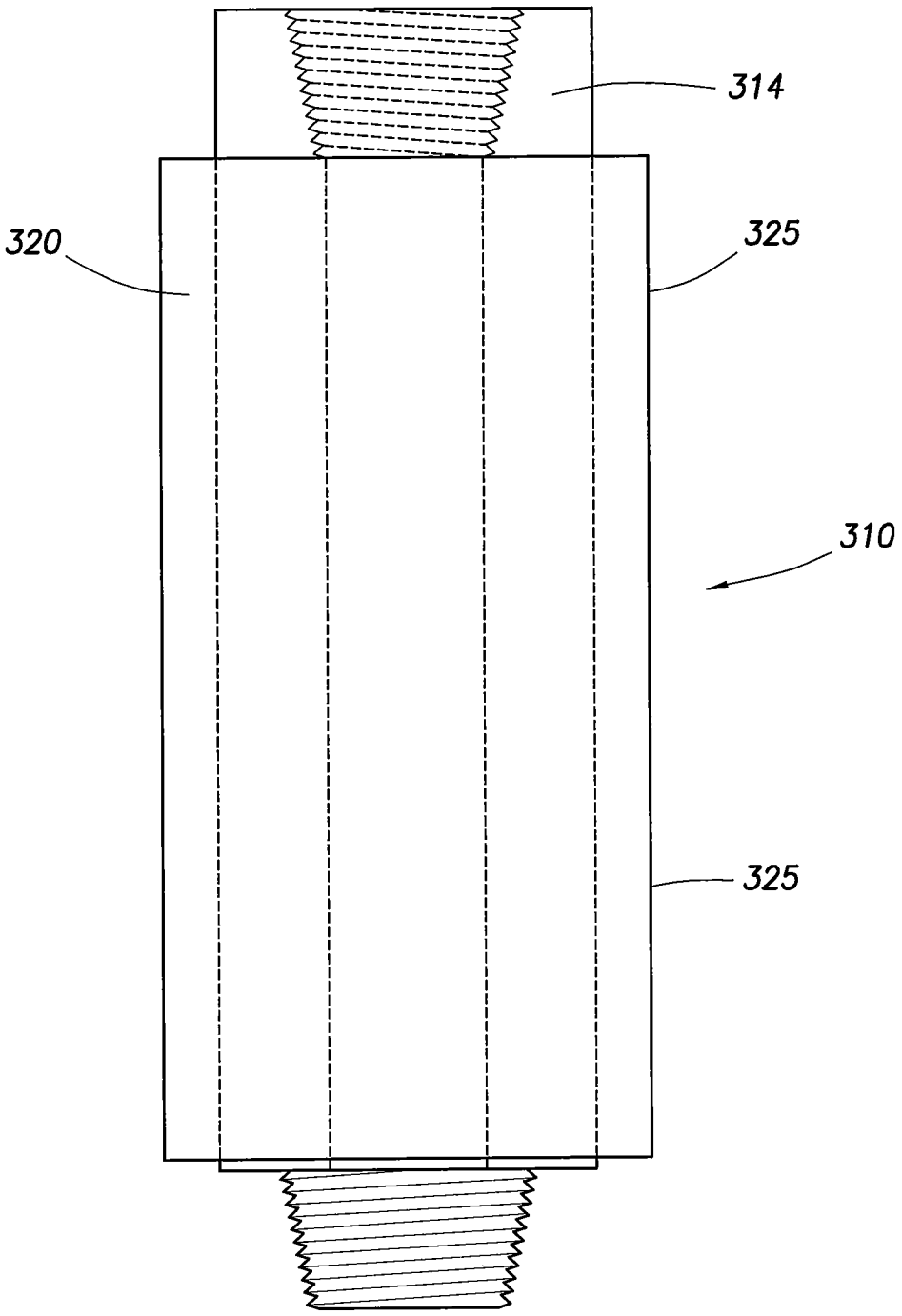
FIG. 7 is a front elevation view of fourth, fifth and sixth embodiments which are similar from the front perspective of a smear tool of the present invention.
Figure 8:
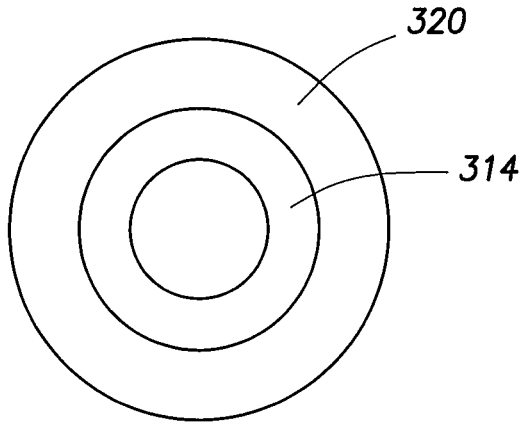
FIG. 8 is a top cross sectional view of the fourth embodiment of the smear tool.

A fourth embodiment of the invention is shown in FIGS. 7 and 8 where smear tool 310 is shown with a full jacket trowel 320. The jacket fully wraps around the body of the smear too 310 where the diameter of the full jacket trowel 320 is approximately the diameter of the drillbit or other tools on the drillstring. There is no leading surface, but the upper and lower edges 325 of the full jacket trowel 320 are preferably angled inwardly to give the wall of the wellbore some relief as the tool is moved up and down the hole. In the fourth embodiment shown in FIG. 8, the full jacket trowel is a solid mass attached to the body 314. This is quite simple, but might be rather heavy.

Figure 9:
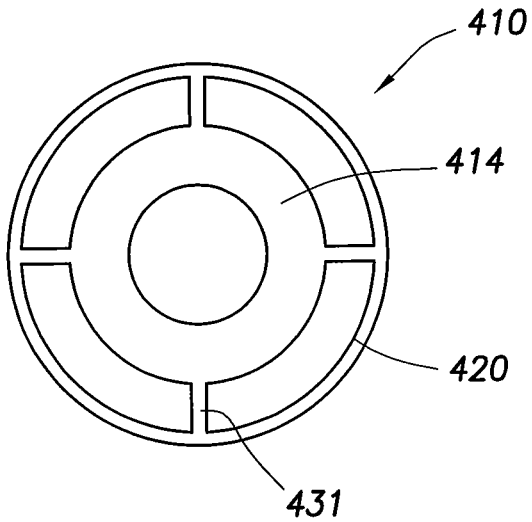
FIG. 9 is a top cross sectional view of the fifth embodiment of the smear tool.

A fifth embodiment of the smear tool 410 is shown in FIG. 9 although it would appear relatively indistinguishable from the fourth embodiment as shown in FIG. 7. Thus, in FIG. 9, radial ribs connect the trowel 420 to body 414. As compared to the fourth embodiment the hollow trowel has a reduced volume of material, and the weight and perhaps the cost would be less. The embodiment in FIG. 9 is anticipated to operate in an equivalent manner to the embodiment in FIG. 8.

Figure 10:
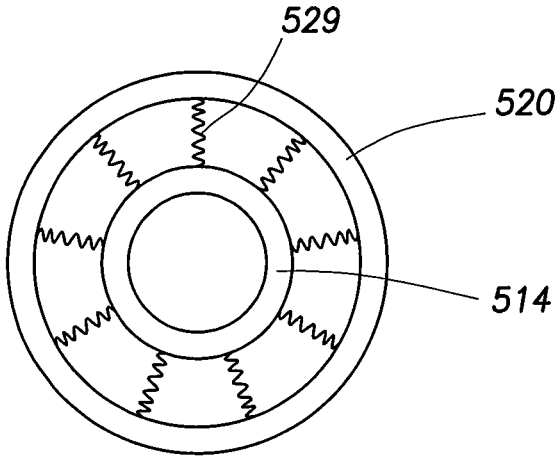
FIG. 10 is a top cross sectional view of the sixth embodiment of the smear tool.

In FIG. 10, a sixth embodiment of the smear tool 510 is similar to the fifth embodiment except that the hollow trowel 520 is mounted to the body 514 by springs 529. Thus, while the massive trowel 520 is able to contact a lot of the wall of the wellbore, there is significant flexibility for wells that are deviating where the drillpipe may be moving around within the wellbore.

Figure 11:
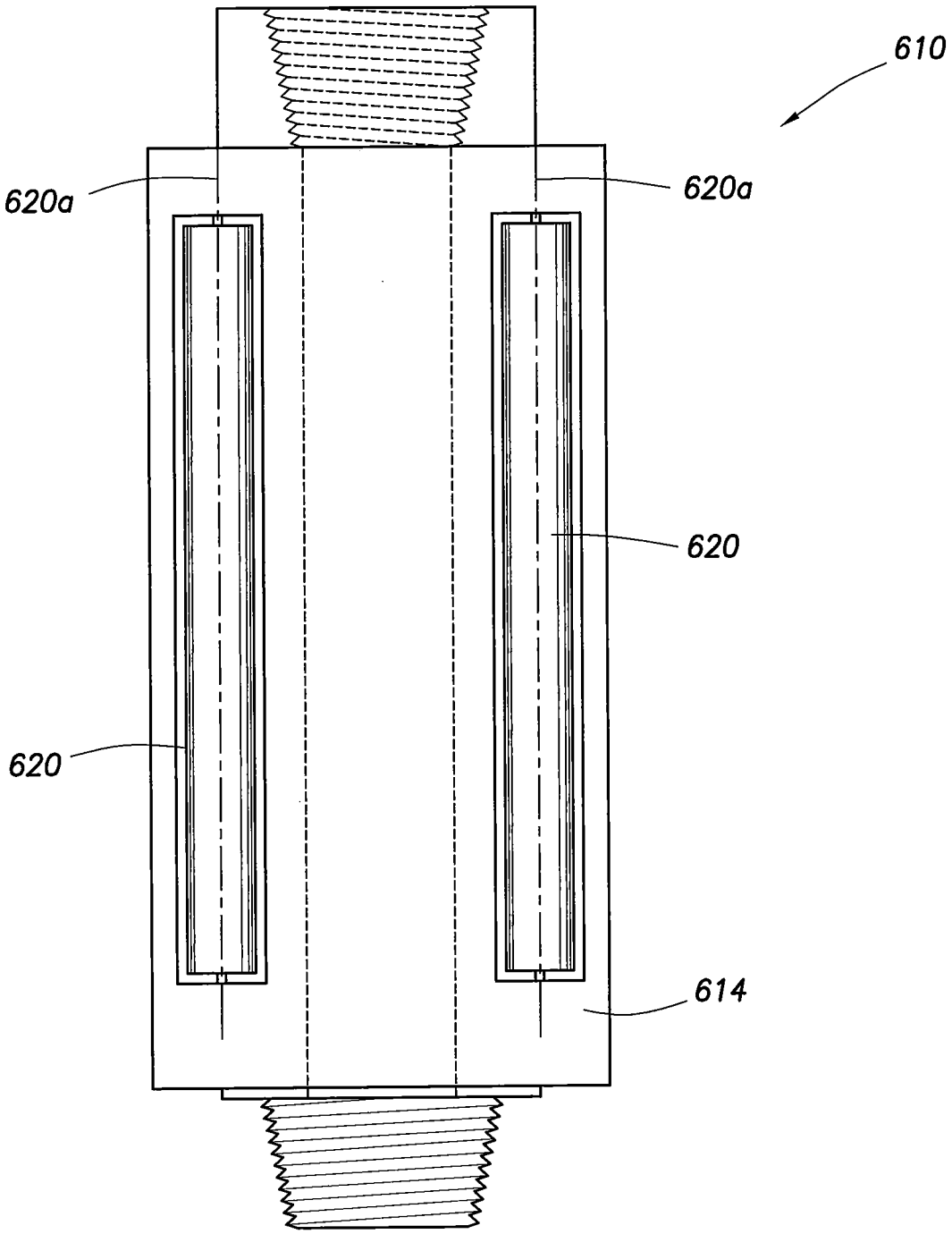
FIG. 11 is a front elevation view of a seventh embodiment of the smear tool.
Figure 12:
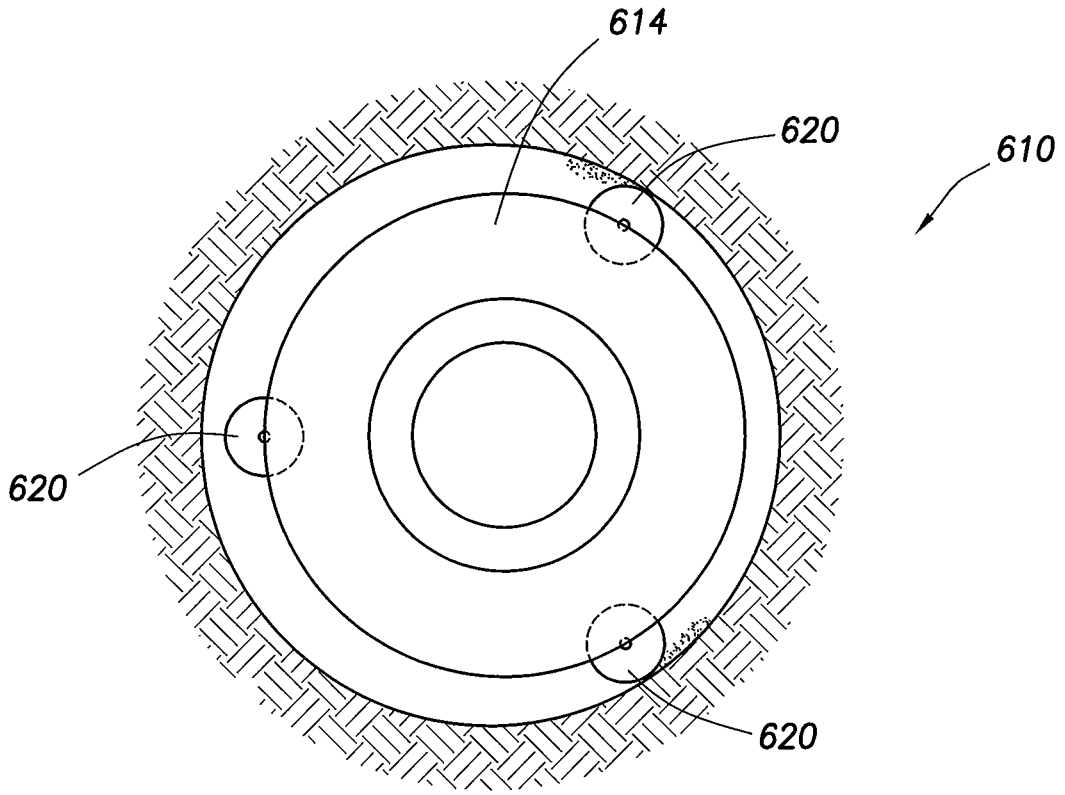
FIG. 12 is a top view of the seventh embodiment of the smear tool.

In FIGS. 11 and 12, a seventh embodiment of the smear tool 610 is shown having a large body 614 and roller trowels 620. Three roller trowels are shown evenly spaced around the body 614, but more or fewer roller trowels 620 could be installed. The body includes recesses to receive the roller trowels 620 and provides rotation on axes 620*a* with mounts upon which the roller trowels may freely rotate as the roller trowels come into contact with the wall of the wellbore. The roller trowels 620 have a generally smooth perimeter that rolls along the inside wall of the wellbore to smear the LCM and cuttings against the wall without scarifying the wall.

These various embodiments of the smear tools would preferably be installed in a drilling assembly, preferably the bottom hole assembly to bring the smear tool as close to the bit as practical. This is desirable because the benefit of the smear tool will only occur when the smear tool reaches the formation. The farther back in the drilling assembly the smear tool is, the longer is the time before the formations are smeared and strengthened. It may be necessary to space multiple smear tools periodically in the drill string. As noted above, it is desirable that the ratio of the smear tool diameter to the wellbore diameter to be greater than 0.75.

It is also desirable that the smear tool would contact all 360 degrees of the borehole circumference at some time during one rotation. If it does not, then some of the wellbore would still be weak—unsmeared. It is desirable, but not critical, that the smear tool would not affect the directional properties of the bottom hole assembly and drilling assembly. If the smear tool is nearly full gage and rigid, it would act like a stabilizer which would impede progress for other aspects of the drilling operation.

It is also desirable that the smear tool smashes cuttings and added LCM into the wellbore wall, not just existing filter cake and mud solids. So the smear tool is designed to direct the flow of mud and cuttings between the tool and the wellbore. Smearing cuttings into the wall may be very important to plugging natural or induced fractures or vugs.

The diameter of these smear tools, for most circumstances, will preferably not be full gage. Typically the preferred diameter would range from about 75 to about 95% of the hole diameter (similar to a casing or liner outside diameter). It is recognized that in certain formations, smear tools that are very close to or at the diameter of the hole might be desirable.

EXAMPLE

The invention was tested in several wells in the Kuparak and Tarn fields in Alaska and two wells in the Piceance field in western Colorado. Each well was drilled using casing drilling or sometimes called casing while drilling (CwD). The first well in the Piceance field using CwD had substantial fluid losses of 13,900 barrels and the smear effect was never realized even though several types of conventional LCMs were used. The second well in the Piceance field using CwD used the special LCM blend and had fluid losses of only 6,500 barrels, the data from this well, shown below, illustrates the effectiveness of the invention.

| | CwD with normal LCM Blend | CwD with special LCM Blend |
|---|---|---|
| Loss Rate | >100 bph (barrels per hour) | 0 bph |
| Percent Returns | 58% | 100% |
| LCM Particle size distribution | 250-2000 microns | 75-2000 microns |
| LCM Concentration | 1.5 lb/bbl | 2.5 lb/bbl |

The third well in the Piceance field using CwD with the special LCM blend had fluid losses of only 3,700 barrels. This is a 73% reduction in fluid loss as compared to the 13,900 barrels of fluid loss in the first well which used conventional LCM.

Another measure of the smear effect is an increase in the maximum pressure that the wellbore will tolerate before fracturing and having fluid losses. This maximum pressure is usually expressed in terms of an equivalent density in pounds per gallon and is measured by imposing pressure on a fluid column at the surface. The higher the equivalent density, the less likely the well is to have fluid losses and longer the well can be the deepened before running and cementing the casing.

| | Tarn Field Test | | Kuparuk Field Test #1 | | Kuparuk Field Test #2 | |
|---|---|---|---|---|---|---|
| | Initial before special LCM | Final after special LCM | Initial before special LCM | Final after special LCM | Initial before special LCM | Final after special LCM |
| Maximum Equivalent Density (lbs/gal) | 13.0 | 15.7 | 12.7 | 14.4 | 13.4 | 18.0 |
| Increase in Maximum Equivalent Density (lbs/gal) | 2.7 | | 1.7 | | 4.6 | |
| LCM Particle size distribution | 75-2000 microns | | 75-2000 microns | | 75-1700 microns | |
| LCM Concentration | 1.4 lb/bbl | | 3.0 lb/bbl | | 2.0 lb/bbl | |

Finally, the scope of protection for this invention is not limited by the description set out above, but is only limited by the claims which follow. That scope of the invention is intended to include all equivalents of the subject matter of the claims. Each and every claim is incorporated into the specification as an embodiment of the present invention. Thus, the claims are part of the description and are a further description and are in addition to the preferred embodiments of the present invention. The discussion of any reference is not an admission that it is prior art to the present invention, especially any reference that may have a publication date after the priority date of this application.

The invention claimed is:

1. A process for drilling a wellbore with a drillbit on the end of a drillstring with minimal loss of drilling fluid and minimal casing operations, where the process comprises:

a) providing a drilling fluid with granular lost circulation material wherein the lost circulation material comprises particles for accomplishing enhanced smear fracture plugging where the particles have a particle size distribution from about 50 microns to about 4000 microns with substantial populations of particles throughout the entire range of the particle size distribution and further wherein the particles of the lost circulation material are in the drilling fluid in a range from at least 0.5 pound per barrel up to 15 pounds per barrel to flow with the drilling fluid and also to form plugs at any lost circulation areas at the periphery of the wellbore and form a filter cake at such lost circulation areas and block or reduce fluid flow from the wellbore into the lost circulation areas, where the lost circulation areas include openings and fissures in the wellbore walls;

b) providing a drillstring having at least one smear tool along a portion of the perimeter of the drillstring to smear filter cakes of lost circulation material into lost circulation areas and compress the lost circulation material into more secure plugs to enhance the performance of the lost circulation material at the lost circulation areas, said smear tool from about 5 to 60 feet long containing a helical trowel with a small front nose (21), a capture surface (25), a broader smear surface (26), and a trailing end (22), where the radial distance of the small front nose (21) is less than the radial distance of the trailing end (22) from a main body of the smear tool, and the capture surface (25) is shaped to capture the particles along the wall of the wellbore and direct the flow of mud and cuttings between the tool and the wellbore, where the smear tool does not scrape or scratch the inside surface of the wellbore, where the smear tool has a smear surface that has an effective diameter of at least about 75% of the diameter of the wellbore and smears the walls of the wellbore as the drill string rotates; and c) rotating the drillstring to drill the wellbore further into the earth and turn the smear tool so that the smear surface smears along the inside surface of the wellbore and especially press the lost circulation materials into a plug of more dense mass of particles and condition the lost circulation areas to reduce lost circulation, pipe sticking, and spalling.

2. The process for drilling a wellbore according to claim 1 wherein the smear tool comprises casing pipe in a casing drilling arrangement or liner pipe in a liner drilling arrangement.

3. The process for drilling a wellbore according to claim 1 wherein the smear tool comprises a tool installed onto a section of drill pipe or between two sections of drill pipe in a conventional drilling arrangement.

4. The process for drilling a wellbore according to claim 1 further including the step of adding lost circulation materials that comprises ground nut shells having a particle size distribution between 5 mesh to about 120 mesh.

5. The process for drilling a wellbore according to claim 1, wherein the lost circulation material includes a combination of about one third fine ground nut hulls with a d50 of about 600 microns; about one third medium ground nut hulls with a d50 of 1500 microns; and one third coarse ground calcium carbonate 250 with a d50 of 250 microns or similarly sized ground nut shells.

6. The process for drilling a wellbore according to claim 1, wherein the lost circulation material includes materials selected from the group of: ground nut shells; calcium carbonate; graphite; coke; carbon; sulfur; plastic; resins; sand; crushed rock; metal particles; ceramic particles; glass beads; expanded perlite particles; hard rubber compound particles; urethane particles; crushed cement; crushed coal and combinations of one or more such materials.

7. The process for drilling a wellbore according to claim 1, wherein particle size distribution is between 75 microns and 1500 microns with substantial populations of particles throughout the entire range.

8. The process for drilling a wellbore according to claim 1, wherein particle size distribution is between 50 microns and 1500 microns with substantial populations of particles throughout the entire range.

9. The process for drilling a wellbore according to claim 1, wherein particle size distribution is between 75 microns and 2000 microns with substantial populations of particles throughout the entire range.

10. The process for drilling a wellbore according to claim 1, wherein particle size distribution is between 50 microns and 2000 microns with substantial populations of particles throughout the entire range.

11. The process for drilling a wellbore according to claim 1, wherein particle size distribution is between 75 microns and 2500 microns with substantial populations of particles throughout the entire range.

12. The process for drilling a wellbore according to claim 1, wherein particle size distribution is between 50 microns and 2500 microns with substantial populations of particles throughout the entire range.

13. The process for drilling a wellbore according to claim 1, wherein particle size distribution is between 100 microns and 3000 microns with substantial populations of particles throughout the entire range.

14. The process for drilling a wellbore according to claim 1, wherein particle size distribution is between 100 microns and 4000 microns with substantial populations of particles throughout the entire range.

15. The process for drilling a wellbore according to claim 1, wherein particle size distribution is between 75 microns and 3000 microns with substantial populations of particles throughout the entire range.

16. The process for drilling a wellbore according to claim 1, wherein the particles of the lost circulation material are in the drilling fluid at less than eight pounds per barrel.

17. The process for drilling a wellbore according to claim 1, wherein the particles of the lost circulation material are in the drilling fluid at less than five pounds per barrel.

18. The process for drilling a wellbore according to claim 1, wherein particle size distribution is between 50 microns and 1500 microns with substantial populations of particles throughout the entire range.

* * * * *